US007554533B2

(12) United States Patent
Benzarti

(10) Patent No.: US 7,554,533 B2
(45) Date of Patent: Jun. 30, 2009

(54) DEVICE FOR IMPROVING PIXEL ADDRESSING

(75) Inventor: Walid Benzarti, Grenoble (FR)

(73) Assignee: Commissariat a l'Energie Atomique, Paris (FR)

( * ) Notice: Subject to any disclaimer, the term of this patent is extended or adjusted under 35 U.S.C. 154(b) by 478 days.

(21) Appl. No.: 10/589,730

(22) PCT Filed: Feb. 24, 2005

(86) PCT No.: PCT/FR2005/050124

§ 371 (c)(1),
(2), (4) Date: Aug. 17, 2006

(87) PCT Pub. No.: WO2005/086130

PCT Pub. Date: Sep. 15, 2005

(65) Prior Publication Data

US 2008/0197784 A1 Aug. 21, 2008

(30) Foreign Application Priority Data

Feb. 27, 2004 (FR) ..... 04 50383

(51) Int. Cl.
*G09G 5/00* (2006.01)

(52) U.S. Cl. ..... 345/204; 345/205; 345/76; 345/82; 345/84; 315/169.1; 315/169.3

(58) Field of Classification Search ... 315/169.1–169.3; 345/45–48, 52, 76, 82, 84, 77, 92, 204, 205, 345/214

See application file for complete search history.

(56) References Cited

U.S. PATENT DOCUMENTS

| | | | | |
|---|---|---|---|---|
| 4,042,854 | A | 8/1977 | Luo et al. | |
| 6,225,750 | B1 * | 5/2001 | Kimura | 315/169.3 |
| 6,518,941 | B1 * | 2/2003 | Kimura | 345/55 |
| 6,693,385 | B2 * | 2/2004 | Koyama | 315/169.1 |
| 6,825,820 | B2 * | 11/2004 | Yamazaki et al. | 345/76 |
| 2003/0222840 | A1 | 12/2003 | Koga et al. | |
| 2007/0080905 | A1 * | 4/2007 | Takahara | 345/76 |

FOREIGN PATENT DOCUMENTS

| | | | |
|---|---|---|---|
| EP | 0 949 603 | A1 | 10/1999 |
| EP | 1 288 903 | A2 | 3/2003 |
| WO | WO 2006/092473 | A1 | 9/2006 |

OTHER PUBLICATIONS

R. M. A. Dawson, et al., "The impact of the Transient Response of Organic Light Emitting Diodes in the Design of Active Matrix OLED Displays", IEDM, 1998, pp. 875-878.

Sang-Hoon Jung, et al., "P-104: A New Voltage Modulated AMOLED Pixel Design Compensating Threshold Voltage Variation of Poly-Si TFTs", SID 02 Digest, XP-001134285, May 21, 2002, pp. 622-625.

* cited by examiner

*Primary Examiner*—Haissa Philogene
(74) *Attorney, Agent, or Firm*—Oblon, Spivak, McClelland, Maier & Neustadt, P.C.

(57) ABSTRACT

The invention relates to a microelectronic device for producing light radiation according to a wide luminance range which can be used, in particular for forming improved screen pixels or, for example OLED-type display pixels.

18 Claims, 3 Drawing Sheets

DEVICE FOR IMPROVING PIXEL ADDRESSING

BACKGROUND OF INVENTION

1. Field of the Invention

This present invention concerns a microelectronic device used to emit light radiation and capable of being used, for example, to form the pixels of displays or of screens, and in particular pixels of the OLED type (Organic Light Emission Displays).

2. Description of the Related Art

The screens of the OLED type are flat screens using the OLED property of organic diode luminescence. In order to regulate the luminescence of an OLED diode associated with a screen or display pixel, a current-driven addressing device, incorporated into the pixel, is generally provided.

An example according to previous designs of such an addressing device associated with an electroluminescent diode 10, of the OLED type for example (Organic Light Emission Diode) is illustrated in FIG. 1. This example of an addressing device firstly includes a first transistor 11, operating as a switch, and whose opening or closure is controlled by a selection signal, in the form of a voltage, denoted vlin, for example.

The addressing device also includes a second transistor 12 used to produce a current id at the input of the electroluminescent diode 10, as a function of a control voltage vdat, with the current id provoking the emission of radiation by the diode 10.

The control voltage vdat is a function of a light or luminance intensity value at which it is desired to fix the radiation emitted by the diode 10.

For a certain value of the selection signal vlin, the first transistor 11 can be put into a "ON" state. The control voltage vdat is then applied to the drain of the first transistor 11, and transmitted to the gate of the second transistor 12, with the latter then emitting the current id at the input of the electroluminescent diode 10.

In order to benefit from a maximum of current stability and a minimum of sensitivity to fluctuations of voltage between its drain and its source, the second transistor 12 is generally polarised to saturated state by a polarising voltage for example, denoted Vdd, of the order of +16 V for example.

A capacitor 13, of the order of 1 pF for example, connected to the gate of the second transistor 12, is also provided to allow retention of the control signal vdat, when the latter is transmitted to the gate of the second transistor 12.

A pixel formed from the aforementioned device, has a contrast that is dependent on the extent of the range of light intensities that the diode is capable of producing. In order to allow the diode 10 to attain a large range of light intensities, the second transistor 12 must preferably be capable of sourcing a large range of currents, and be able to produce both "low" currents of the order of a few tens of nanoamperes for example, of the order of 50 nA for example, or "high" currents, of the order of a few microamperes for example, 5 μA in saturation mode for example. The extent of said range of currents, as well as the current values in this range, are dependent in particular on the manner in which the first 11 and the second transistor 12 are polarised.

In an addressing device for a screen or display pixel of the type just described, the first transistor 11 and the second transistor 12 can be transistors of the TFT (Thin Film Transistor) type, manufactured in polycrystalline silicon technology. This type of transistor, frequently used in pixel addressing devices, has some limitations.

Such a TFT transistor is generally limited regarding the extent of the range of current that it is capable of sourcing, in particular in relation to an MOS transistor in monocrystalline silicon technology. This limitation can adversely affect the performance, in particular in terms of contrast, of the pixels using this technology. The TFT transistors in polycrystalline silicon technology also have the drawback of having a slow transition between the cut-off state, which we will call "OFF" and the saturated state, which we will call "ON".

If we now relate this problem to the case of the addressing device illustrated in FIG. 1, so that the diode 10 can emit radiation with sufficiently high light intensities, then the control voltage vdat must preferably reach high levels too. High values of the control voltage vdat result in high consumption values.

Given the slow transition between the "ON" and "OFF" modes of the TFT polycrystalline silicon transistors, so that the diode 10 can emit radiation according to an extended range of light intensities, the difference between the maximum value, denoted Vdatmax, of the control voltage vdat and the minimum value, Vdatmin, of this same control voltage, is generally large.

So that the diode 10 emits at high light intensities, the voltage between the drain and the source of the first transistor 11 is generally large. This can have as a consequence the occurrence of leakage currents in the first transistor 11. The capacitor 13 used to maintain the control signal vdat at the input of the second transistor 12 can then tend to discharge.

Now poor retention of the control signal vdat at the input of the second transistor 12 can result, for a given pixel, in a random variation in the light intensity emitted by said pixel.

For example, when the second transistor is of the TFT type, polarised with a voltage Vdd of 16 volts, to reach a minimum value of current at the input of the diode 10 of the order of 50 nA, Vdat2min can be of the order of 8, 3 volts for example. To reach a maximum value of current at the input of the diode 10 of the order of 5 μA, the maximum value of the control voltage, denoted Vda2max, can be of the order of 16, 6 volts for example.

The problem arises to improve the performance of the screen or display pixels, of the OLED type for example, in particular in terms of contrast and power consumption. There is also the problem of preventing random variations in the light intensity produced by these pixels.

SUMMARY OF THE INVENTION

The invention concerns a microelectronic device used to produce total light radiation that includes:

- first electroluminescent means designed to produce a first radiation with a first light intensity or a first luminance,
- first control means designed to control the first electroluminescent means by means of a first current with a level belonging to a first range of levels,
- second electroluminescent means designed to produce a second radiation with a second light intensity or a second luminance,
- second control means designed to control the second electroluminescent means, by means of a second current with a level belonging to a second range of levels different from the first, with the total light radiation produced having a total light intensity or luminance which is a combination of said first light intensity or luminance and of said second light intensity or luminance.

The microelectronic device of the invention can be used to form an improved screen or display pixel.

Throughout this present description, the term luminance refers to values of emitted light intensities referred to a given value of a given area, such as a value equal to the area of said microelectronic device for example or of a display or screen pixel formed from said microelectronic device. Thus by said first luminance is meant the ratio between said first light intensity and a given area. By said second luminance is meant the ratio between said second light intensity and said given area.

At least several levels of said first range of levels to which the first current belongs can be lower than the levels of said second range of levels to which the second current belongs. Thus, according to a variant, said first range of current levels and second range of current levels can overlap. According to another variant, said first range of levels and second range of levels can be distinct and not overlap. The first range of levels can then include current values that are all lower than the current values of said second range of levels, for example.

Using first control means designed to emit currents belonging to a first range of currents and second control means designed to emit currents belonging to another range of currents, different from the first, enables one to facilitate the determination of contrast in a pixel formed from the microelectronic device of the invention without increasing the polarisation stresses on the addressing device of this pixel.

The first electroluminescent means and second electroluminescent means can be formed by a first photodiode and a second photodiode respectively, using organic diodes of the OLED type for example. These first and second electroluminescent means are designed to function alternately or simultaneously.

According to one implementation variant, one of said first or second electroluminescent means can function in a mode called "on-off", and be capable of producing radiation with a given light intensity or of a given luminance, or not to emit, while the other of said first or second electroluminescent means can function in another mode called "analogue" and be capable of producing light radiation with a light intensity or of a luminance varying between a light or luminance intensity of minimum value and a light or luminance intensity of maximum, non-zero value.

The first electroluminescent means and the second electroluminescent means can be similar or different.

The first electroluminescent means and the second electroluminescent means can be created using similar or different technologies.

The first and second electroluminescent means can be of similar or different sizes.

Thus, the first electroluminescent means and the second electroluminescent means can be formed respectively from a first photodiode for example, and from a second photodiode of identical or different size or with identical or different emitting areas.

In the case, for example, where the first electroluminescent means and second electroluminescent means are formed respectively from a first photodiode of the OLED type and from a second photodiode of the OLED type, stressed differently in relation to each other in terms of frequency of use or/and of mean light intensity to be produced, it can turn out to be advantageous to arrange for the first and the second photodiodes to be of different size.

For example, of said first and second photodiodes, the photodiode that is least in demand in terms of frequency of use or/and of mean light intensity or of mean luminance to be supplied can be designed so as to have a smaller size or a smaller emitting area than the other photodiode that is more in demand in terms of frequency of use or/and of mean light intensity or of mean luminance to be supplied. This particular method of implementation can be used to increase the life expectancy of the microelectronic device of the invention.

The first and/or second control means can be fitted with switching means, in the form of a first and/or of a second transistor switch for example, of the TFT type for example.

The first control means can include current modulating means in the form of a transistor for example, such as a transistor of the TFT type, used to modulate the current at the input of the first electroluminescent means. The second control means can include current modulating means in the form of another transistor for example, such as a transistor of the TFT type, used to modulate the current at the input of the second electroluminescent means. According to one advantageous implementation method, the current-modulating transistor included in the first control means can be formed with a ratio denoted $W_1/L_1$, between the width of its channel denoted $W_1$, and the length of its channel denoted $L_1$, with the ratio $W_1/L_1$ being less than another ratio denoted $W_2/L_2$, between the width denoted $W_2$, and the length denoted $L_2$, of the channel of the other transistor, included in the second control means.

The switching means of the first control means and of the second control means can be controlled by a given signal for example, in the form of a voltage known as a "selection" voltage for example.

The current modulating means of the first control means and of the second control means can be controlled by different signals, respectively by a first voltage known as the "adjusting" voltage and a second voltage known as the "adjusting" voltage for example.

The microelectronic device of the invention can be suitable for forming an improved display or screen pixel, mainly in terms of power consumption.

The device of the invention allow one to reduce the polarisation stresses on the current modulating means and on the electroluminescent means in relation to pixel addressing devices of previous design. The levels of the adjusting voltages used to determine the levels of the currents at the input of the first electroluminescent means and of the second electroluminescent means respectively of the device of the invention can thus be reduced in relation to the level of the adjusting voltages used for the pixel addressing devices of previous design. Thus the consumption induced by any pixel created can be improved.

With the device of the invention, the minimum and maximum levels of the adjustment signals used to determine the levels of current at the input of the electroluminescent means, can be reduced in relation to those used with the pixel addressing devices of previous design. This has the consequence of facilitating the retention of these adjustment signals at the input of the current modulating means. At the level of a pixel, this can in particular allow a reduction in the phenomenon of random variations in the light intensity emitted by the latter.

BRIEF DESCRIPTION OF THE DRAWINGS

This present invention will be understood better on reading the description of the implementation examples, provided for guidance only and in no way limiting, with reference to the appended drawings, in which.

Figure 1:
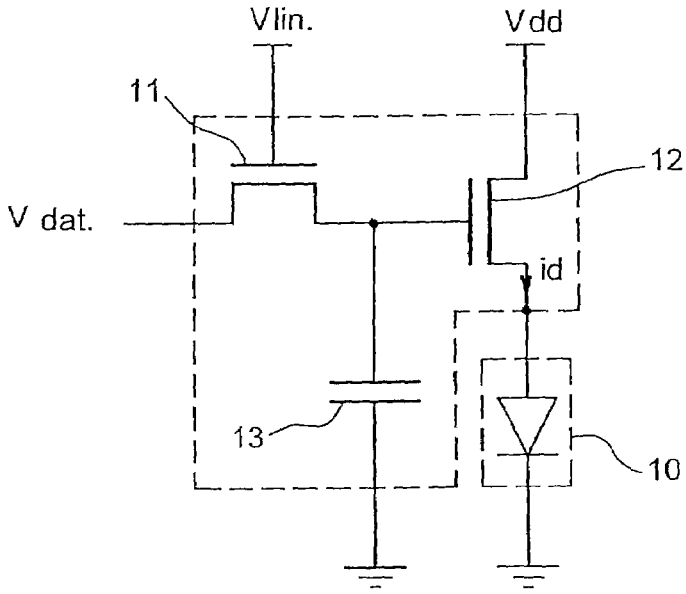
FIG. 1 PRIOR ART
FIG. 1, illustrates an example of a device of previous art.

The different parts shown in the figures are not necessarily to a uniform scale, in order to render figures easier to read.

DETAILED DESCRIPTION OF PARTICULAR EMBODIMENTS

An example of a microelectronic device implemented according to the invention will now be described with reference to FIG. 2.

This device firstly includes first and second electroluminescent means respectively in the form, for example, of a first electroluminescent diode 110, which is organic and of the OLED type for example, and a second electroluminescent diode 120 of the same type as the first diode 110 for example.

The diodes 110 and 120 are current controlled respectively by first control means 130 and second control means 140, and can function alternately or simultaneously.

The first diode 110 is designed to receive as input a current denoted id1, coming from the first control means 130 and whose value belongs to a first range known as "low-current values", ranging from a minimum value, Id1min, of the order of several tens of nanoamperes for example, equal to 50 nA for example, to a maximum value, Id1max, between several hundreds of nanoamperes and several microamperes for example, of the order of 1 μA for example.

As a function of the value of the current id1 at its input, the diode 110 produces light radiation of low intensity and luminance, the luminance being in a range known as the "low luminance range", located between a minimum value, denoted L1min, of the order of 1 cd/m$^2$ for example, and a maximum value of L1max, of the order of 20 cd/m$^2$ for example.

The first control means 130 producing the current id1 at the input of the first diode 110, first includes switching means. These switching means can take the form of a first transistor switch 131 for example, such as a transistor of the TFT type, whose opening and closure are controlled by a selection signal in the form of a voltage, denoted vsel, applied to its gate.

The first control means 130 also include means for modulating the current id1 at the input of the first diode 110, as a function of a control signal in the form of a voltage denoted vdat1. The means for modulating the current id1 take the form of a second modulating transistor 132, such as a transistor of the TFT type for example, and polarised preferably into saturation mode by a polarising voltage denoted Vdd, of the order of +16V for example.

The control voltage, vdat1, can be applied to the drain of the first transistor 131. When the latter is switched to the "ON" state by the selection voltage, vsel, of the order of 18 volts for example, the control voltage, vdat1, can be transmitted to the gate of the second transistor 132, the latter then emitting current id1 at the input of the first diode 110, as a function of the value of control voltage vdat1 received at its gate.

Thus, the intensity and the luminance of the light radiation emitted by the first diode 110 is a function of the value of current id1, itself controlled by control voltage vdat1.

Figure 2:
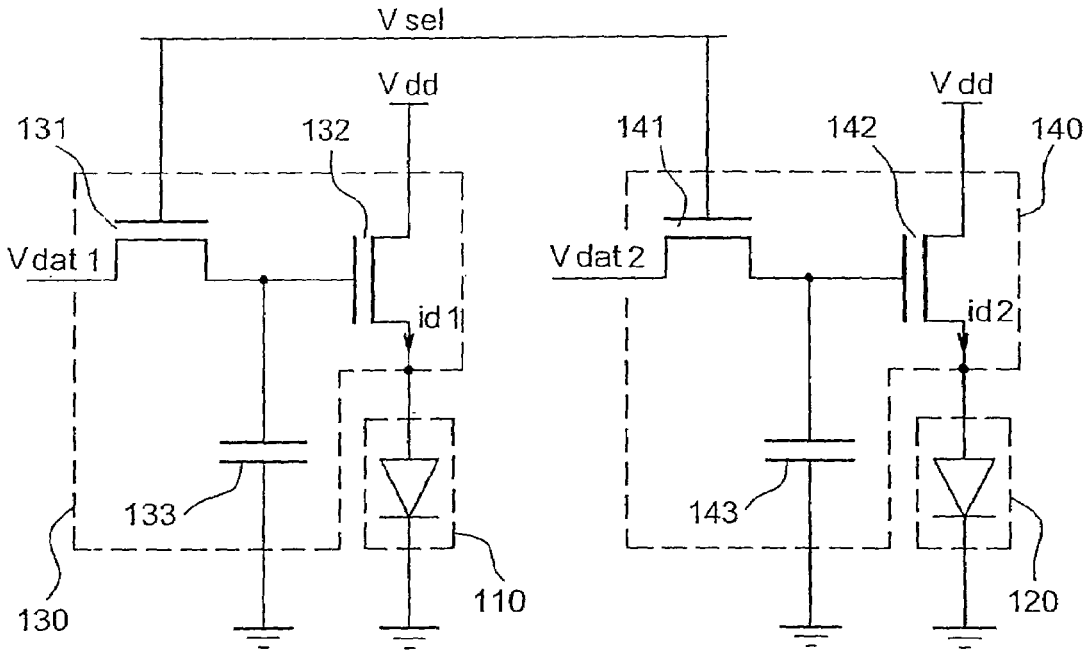
FIG. 2, illustrates an example of a device of the invention.

Control voltage vdat1 is emitted via an external circuit to the device illustrated in FIG. 2 and preferably limited between a minimum value, Vdat1$_{min}$, and a maximum value, Vdat1$_{max}$. These minimum Vdat1$_{min}$ and maximum Vdat1$_{max}$ values respectively determine the minimum light intensity and luminance L1min and the maximum light intensity and luminance L1max that the first diode 110 is capable of producing.

For example, for a second transistor 132 of the TFT type, with a channel-width to channel-length ratio of the order of 10/60, polarised by means of a voltage Vdd equal to 16 volts, Vdat1min can be of the order of 9, 05 volts in order to obtain a current, Id1min, of the order of 50 nA and Vdat1max of the order of 13, 75 volts in order to obtain a current Id1max of the order of 1 μA.

Means incorporated into the first control means 130, taking the form of a capacitor 133 for example, with a capacitance of the order of 0, 5 pF for example, connected to the gate of the second transistor 132, are provided to allow retention of the control signal vdat1 at the input of the second transistor 132 when the first transistor 131 is at the "OFF" state.

In the case of the second diode 120, the latter is designed to receive a current, denoted id2, coming from the second control means 140. The current id2 at the input of the second diode 120 has a value that belongs to another range of levels that are higher than those of said first range of levels to which current id1 at the input of the first diode 110 belongs. This other range of levels is between a minimum value, denoted Id2 min, of the order of 1 μA for example, and a maximum value, denoted Id2max, of the order of several microamperes for example, of 4 μA for example.

It can be arranged for example that the range of levels to which current id1 at the input of the first diode 110 belongs and the other range of levels to which current id2 at the input of the first diode 110 belongs should be distinct.

According to a variant, it can be arranged that the range of levels to which current id1 belongs and the other range of levels to which current id2 belongs should overlap.

As a function of the value of current id2 at its input, the second diode 120 can produce light radiation with an intensity and luminance that lie in a second range of intensities and luminances, with the second luminance range going from a minimum luminance value denoted L2min, of the order of 20 cd/m$^2$ for example, to a maximum luminance value denoted L2max, of the order of 80 cd/m$^2$ for example.

The second control means 140 used to control the illumination of the second diode 120, are of the same type as the first control means 130 used to control the illumination of the first diode 110. The second control means 140 also include switching means whose opening and closure are controlled by selection voltage vsel. The switching means of the second control means take the form of another first transistor switch 141 for example, of the TFT type for example.

The second control means 140 also include means used to modulate the current id2 at the input of the second diode 120 as a function of the value of another control signal in the form of a voltage denoted vdat2, applied to the drain of the other first transistor 141. The means for modulating current id2 at the input of the second diode 120 can take the form of another second transistor 142 whose source is connected to the second diode 120 and which, when it receives the other control voltage vdat2 at its gate, emits current id2 at the input of said second diode 120.

The other second transistor 142 can be a transistor of the TFT type for example. This is preferably polarised into saturation mode, by polarising voltage Vdd for example. The other second modulating transistor 142 is designed to receive the other control voltage, vdat2, when the other first transistor 141 is switched to the "OFF" state by voltage vsel. This voltage vdat2 is emitted via an external circuit to the device illustrated in FIG. 2, and preferably limited between a minimum value, denoted $Vdat2_{min}$, and a maximum value denoted $Vdat2_{max}$. The minimum and maximum values of voltage vdat2 respectively determine the minimum luminance, denoted L2min, and the maximum luminance, denoted L2max, that the second diode 120 is capable of producing.

As an example, when the other second transistor 142 is of the TFT type, with a channel-width to channel-length ratio of the order of 10/20, polarised by means of a voltage Vdd equal to 16 volts, the minimum value Vdat2min of the other control voltage can be of the order of 12.8 volts to obtain a minimum current Id2min at the input of the second diode of the order of 1 μA. The maximum value Vdat2max of the other control voltage vdat2, can be of the order of 15.3 volts to obtain a current with a maximum value of Id2max of the order of 4 μA at the input of the second diode 120.

Thus, according to a particular method of implementation of the invention, the other control voltage vdat2 at the input of the second control means 140 can belong to a range of voltages that is different from the range of voltages to which control voltage vdat1 at the input of the first control means 140 belongs.

Means are also provided to allow retention of the other control voltage vdat2 at the input of the other second transistor 142, when the other first transistor 141 is at the "open" state. These means take the form of a second capacitor 143 for example, with a capacitance of the order of 0.5 pF for example.

The first capacitor 133 and the second capacitor 143 can have different capacitance values, and these values are chosen respectively as a function of the respective ranges to which adjusting voltages vdat1 and vdat2 belong. For example, in the case where vdat2 belongs to a higher range of voltages than those of the range to which voltage vdat1 belongs, then the first capacitor 133 can be designed to have a capacitance that is less than that of the second capacitor 143. Thus, the plates of the first capacitor 133 can occupy a smaller area than those of the second capacitor 143 for example.

The control means 130 and 140 of the diodes 110 and 120 differ from each other in particular by their current modulating means. The current modulating means of the first control means 130 are designed to emit a current id1 in a range of levels that is lower than that of current id2 that is capable of being emitted by the other current modulating means of the second control means 140.

In order to allow this, in a particular method of implementation, the other second current modulating transistor 142, belonging to the first control means 140, can be designed for example so as to have a shorter channel than the channel of the second current modulating transistor 132 belonging to the first control means 130.

The second transistor 132 can be formed with a ratio, denoted $W_1/L_1$, of the width of its channel, $W_1$, to the length, $L_1$, of its channel, of the order of 10/60 for example, while the other second transistor 142 can be formed with another ratio, denoted $W_2/L_2$, of the order of 10/20 for example, of the width, $W_2$, of its channel to the length, $L_2$, of its channel, that is higher than the ratio $W_1/L_1$.

The aforementioned microelectronic device can be used to form a pixel of a screen or display for example. It can allow the pixel to produce light radiation with an intensity and luminance that belong to a wide range of intensity and luminance respectively, with the luminance range capable of being between a minimum luminance value, denoted Lmin, of the order of 12 cd/m$^2$ for example, and a maximum luminance value, Lmax, of the order of 120 cd/m$^2$ for example, while retaining reduced power consumption.

The pixel can be shared between a first sub-pixel, formed, for example, from the first diode 110 associated with the first control means 130, and a second sub-pixel formed from the second diode 120 associated with the second control means 140.

Selection of said pixel from a collection of screen or display pixels, can be effected by means of the selection signal, vsel, common to the first sub-pixel and to the second sub-pixel, and coming from a circuit external to the screen or to the display.

The value of the total intensity or of the total luminance of the light radiation emitted by said pixel can be controlled by control signal vdat1 and the other control signal vdat2, applied respectively to the first sub-pixel and to the second sub-pixel, coming from a circuit external to the screen or to the display.

The first sub-pixel can be created, for example, to produce radiation with an intensity or luminance of the "low" type that lies within a first range of intensities or luminances whose value is a function of control signal vdat1.

The second sub-pixel can be designed to produce radiation with intensities or luminances described as "high" that lie in a second range of levels or of luminances that are higher than those of the first range of levels or luminances, and whose value is a function of the other control signal, vdat2.

The first sub-pixel and the second sub-pixel can function alternately or simultaneously as a function of the value of the adjusting signals, vdat1 and vdat2, and of the total value of intensity or luminance that one wished to assign to said pixel.

Figure 3:
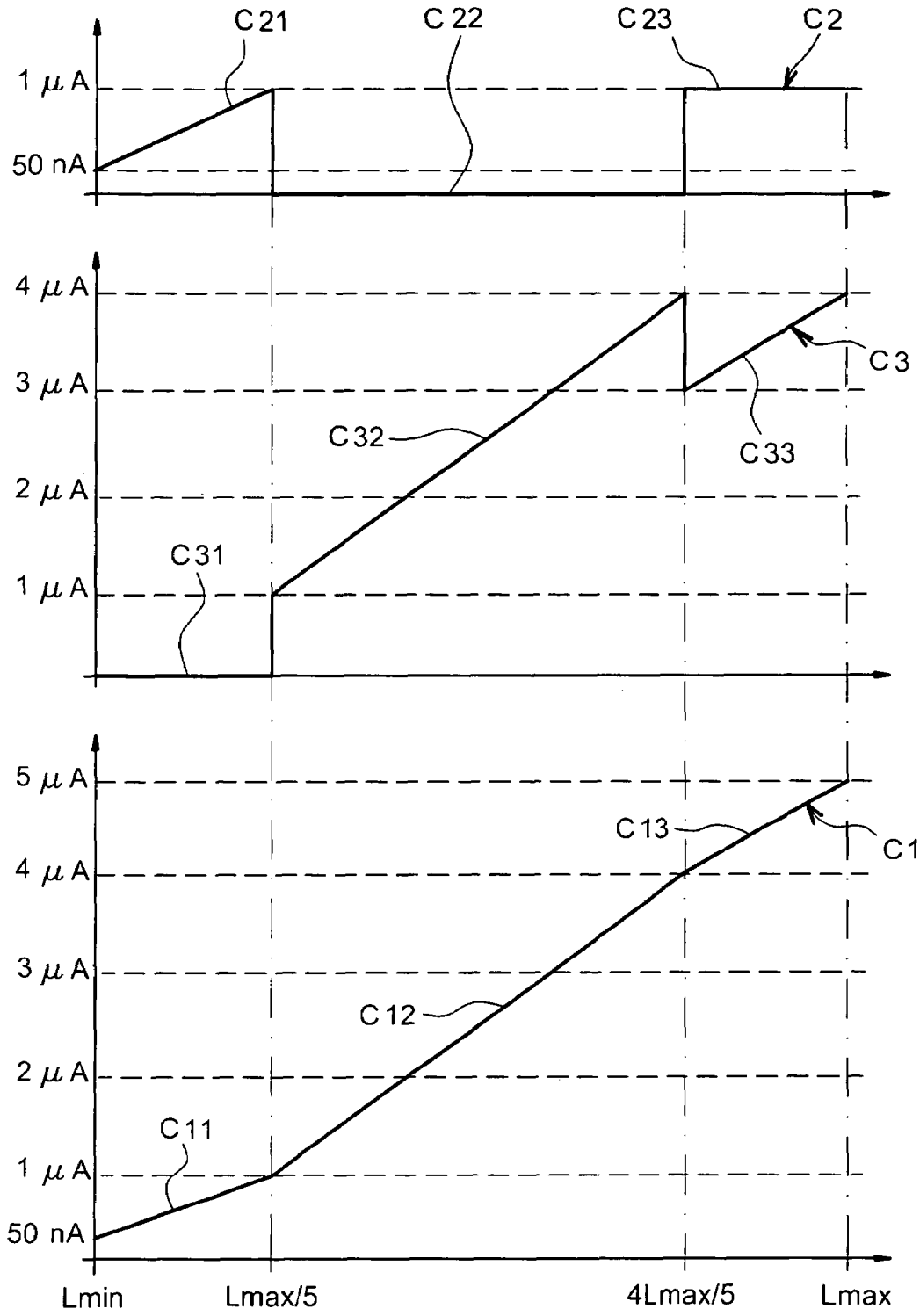
FIG. 3, illustrates an example of an operating diagram of a pixel including the device of the invention.

Examples of an operating diagram of a pixel implemented according to the invention, and those of a first sub-pixel and a second sub-pixel forming said pixel, are illustrated in FIG. 3, by graphs $C_2$, $C_3$ and $C_1$ respectively.

In this example, the total luminance emitted by the pixel is between a minimum luminance value denoted Lmin, of the order of 12 cd/m$^2$ for example, and a maximum luminance value, denoted Lmax, of the order of 120 cd/m$^2$ for example.

In this example, the first sub-pixel and the second sub-pixel produce ranges of intensity or of luminance that are distinct and contiguous.

When the pixel produces "low intensities or luminances" that lie in a first range, located between Lmin, of the order of 12 cd/m$^2$ for example, and Lmax/5, of the order of 24 cd/m$^2$ for example rising portion C11 of graph C1, it can be the first sub-pixel which emits light radiation rising portion C21 of graph C2 while the second sub-pixel does not emit constant portion C31 of graph C3. This first range, described as of "low intensity or low luminance" is produced for radiation coming from the first diode 110 when the latter receives an input current id1 that belongs to a range of currents of low intensity ranging from 50 nA to 1 μA for example.

When the pixel produces "high" intensities or luminances, belonging to a second range of levels or of luminances, the latter being between Lmax/5, of the order of 24 cd/m$^2$ for example and 4Lmax/5 portion C12 of graph C1), of the order of 96 cd/m$^2$ for example, it can be the second sub-pixel which emits light radiation rising portion C32 of graph C3 while the first sub-pixel does not emit constant portion C22 of graph C2.

The second range of levels or of luminances, described as "of high intensity or luminance", is thus produced for light radiation coming from the second diode 120 when the latter receives an input current id2 belonging to a second range of currents with intensities ranging from 1 μA to 4 μA for example.

Illumination of the pixel according to "the highest" values of intensity or luminance, with the latter situated in a third luminance range, located between 4Lmax/5 for example, of the order of 96 cd/m$^2$ for example, and Lmax, of the order of 120 cd/m$^2$ for example portion C13 of graph C1, can be effected both by illumination of the first sub-pixel and illumination of the second sub-pixel. The third range, described as being of "the highest" intensities or luminances, can be obtained by radiation coming from the first diode 110 constant portion C23 of graph C2, triggered by a first current id1 at the input of the latter, and between 50 nA and 1 μA for example, and by radiation coming from the second diode 120 rising portion C33 of graph C3 triggered by a second current id2 at the input of the latter and between 1 μA and 4 μA for example.

According to an example of operation that is different from that just described, it can be arranged that the first sub-pixel and the second sub-pixel emit constantly and simultaneously. Thus, light radiation emitted by the pixel of the invention can be formed constantly from a combination of radiation coming from the first sub-pixel and separate light radiation coming from the second sub-pixel.

According to another example of operation which is different from those just described, it can be arranged that a pixel implemented according to the invention is formed firstly from a first sub-pixel operating in a mode which we will call "on-off", and a second sub-pixel operating in another mode that we will call "analogue". Thus, the first sub-pixel will be designed to emit radiation with a given luminance or not to emit, while the second sub-pixel will emit constantly with a value of intensity or of luminance that is designed to vary.

A screen or display pixel is generally associated with an elementary area, capable of producing light radiation with a given wavelength and a given intensity or luminance.

A pixel P implemented according to the invention, in a screen or display, is divided into a first zone and a second zone associated respectively with a first sub-pixel, denoted P1, and a second sub-pixel, denoted P2.

The first sub-pixel P1 and the second sub-pixel P2 respectively include a first area S1 designed to emit radiation with a certain light intensity, and a second area S2 designed to emit radiation with another light intensity.

Areas S1 and S2 are designed to emit on wavelengths that are close or identical.

The first area S1 and the second area S2 can be the same or different. For example, in the case where the first sub-pixel P1 and the second sub-pixel P2 respectively include a first organic photodiode and a second organic photodiode, then areas S1 and S2 correspond respectively to an emitting area of the first organic photodiode and to an emitting area of the second organic photodiode. By emitting area is meant an area designed to emit light radiation.

Areas S1 and S2 are each designed to emit light radiation either simultaneously or alternately.

Figure 4A:
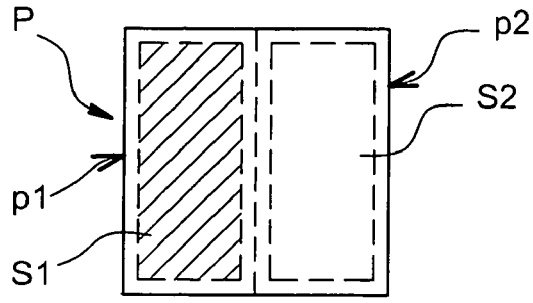
FIGS. 4A, 4B, 4C illustrate the principle of operation of a screen or display pixel implemented according to the invention, Identical, similar or equivalent parts of the different figures bear the same numerical references so as to facilitate the passage from one figure to the next.

Consider a pixel P implemented according to the invention, whose principle of operation is the same as that described with reference to FIG. 3. In order that the pixel should emit at the first range of low luminances or low intensities, it is the first area S1 for example which emits light radiation, while the second area S2 does not emit FIG. 4A.

Figure 4B:
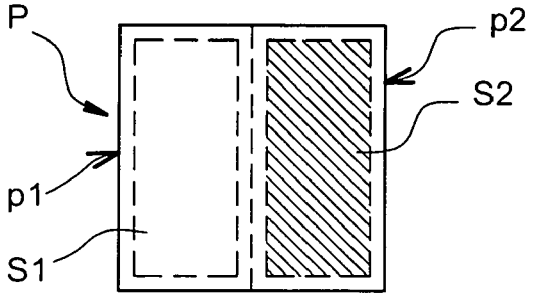

In order that the pixel should emit according to the second range of high luminances or high intensities, it is the second area S2 for example which emits light radiation, while the first area S1 does not emit FIG. 4B.

Figure 4C:
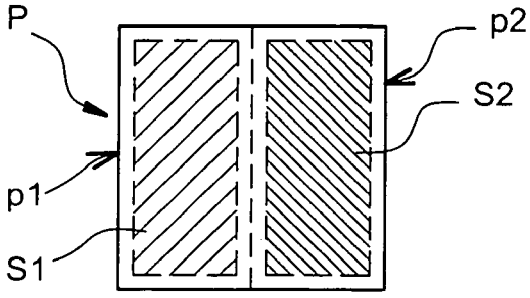

In order that the pixel should emit according to the third range of highest luminances or intensities, then second area S2 and the first area S1 both emit at the same time FIG. 4C.

The invention claimed is:

1. A microelectronic device used to produce light radiation, comprising:

first electroluminescent means for producing first radiation of a first luminance;

first control means for producing a variable current according to a first range of levels, and to control the first electroluminescent means by a first current with a level belonging to the first range of levels;

second electroluminescent means for producing second radiation of a second luminance; and second control means for producing a variable current according to a second range of levels, and to control the second electroluminescent means, by a second current with a level belonging to the second range of levels, with the light radiation having a total luminance which is a combination of the first luminance and of the second luminance.

2. A device according to claim 1, wherein plural intensities of the first range of levels to which the first current belongs are lower than intensities of the second range of levels to which the second current belongs.

3. A device according to claim 1, wherein the first and second control means each include switching means.

4. A device according to claim 3, wherein the switching means of the first control means and the second control means are controlled by a given signal.

5. A device according to claim 3, wherein the switching means of the first control means includes at least one first transistor switch.

6. A device according to claim 5, wherein the switching means of the second control means includes at least one second transistor switch.

7. A device according to claim 1, wherein the first and second control means each include current modulating means.

8. A device according to claim 7, wherein the current modulating means of the first control means includes at least a first current modulating transistor.

9. A device according to claim 8, wherein the means for modulating the second control means includes at least a second current modulating transistor.

10. A device according to claim 9, wherein the first control means includes a first current-modulating transistor with a channel of length $L_1$ and width $W_1$, the second control means includes a second current-modulating transistor with a channel of length $L_2$ and width $W_2$, with the ratio $W_2/L_2$ is greater than the ratio $W_1/L_1$.

11. A device according to claim 7, wherein the current modulating means of the first control means is controlled by a first control signal, and the current modulating means of the second control means is controlled by a second control signal.

12. A device according to claim 11, wherein the first control signal belongs to a first range of voltages, and the second control signal belongs to a second range of voltages that is different from the first range of voltages.

13. A device according to claim 11, wherein the first control means further includes at least one first capacitor configured to retain the first control signal.

14. A device according to claim 13, wherein the second control means further includes at least one second capacitor configured to retain the second control signal.

15. A device according to claim 1, wherein the first and second electroluminescent means each include an organic photodiode.

16. A device according to claim 1, wherein the first electroluminescent means includes a first photodiode, the second electroluminescent means includes a second photodiode, and the first photodiode and the second photodiode have different emitting areas.

17. A device according to claim 1, wherein the first electroluminescent means and the second electroluminescent means are configured to function alternately or simultaneously.

18. A display or screen pixel that includes a microelectronic device according to claim 1.

* * * * *